US005455888A

United States Patent [19]

Iyengar et al.

[11] Patent Number: 5,455,888

[45] Date of Patent: Oct. 3, 1995

[54] SPEECH BANDWIDTH EXTENSION METHOD AND APPARATUS

[75] Inventors: Vasu Iyengar, Pointe Claire; Rafi Rabipour; Paul Mermelstein, both of Cote St-Luc; Brian R. Shelton, Kanata, all of Canada

[73] Assignee: Northern Telecom Limited, Montreal, Canada

[21] Appl. No.: 985,418

[22] Filed: Dec. 4, 1992

[51] Int. Cl.[6] ..... G10L 5/06

[52] U.S. Cl. ..... 395/212; 395/2.1; 395/2.17; 395/2.28; 395/2.32

[58] Field of Search ..... 395/2, 2.28, 2.25, 395/2.31, 2.34, 2.35, 2.23, 2.32, 2.1, 2.12, 2.17

[56] References Cited

U.S. PATENT DOCUMENTS

| | | | |
|---|---|---|---|
| 4,330,689 | 5/1982 | Kang et al. | 395/2.12 |
| 4,815,134 | 3/1989 | Picone et al. | 381/31 |
| 4,850,022 | 7/1989 | Honda et al. | 381/36 |
| 5,007,092 | 4/1991 | Galand et al. | 381/36 |
| 5,233,660 | 8/1993 | Chen | 395/2.31 |

OTHER PUBLICATIONS

Trends in Audio & Speech Compression for Storage and Real–Time Communication Mermelstein, IEEE/Apr. 1991.

A Low Delay 16 kb/s Speech Coder Iyengar et al., IEEE/May 1991.

Statistical Recovery of Wideband Speech From Narrowband Speech Cheng et al., IEEE/Oct. 1994.

*Primary Examiner*—Allen R. MacDonald

*Assistant Examiner*—Richemond Dorvil

*Attorney, Agent, or Firm*—Dallas F. Smith; John A. Granchelli

[57] ABSTRACT

A speech bandwidth extension method and apparatus analyzes narrowband speech sampled at 8 kHz using LPC analysis to determine its spectral shape and inverse filtering to extract its excitation signal. The excitation signal is interpolated to a sampling rate of 16 kHz and analyzed for pitch control and power level. A white noise generated wideband signal is then filtered to provide a synthesized wideband excitation signal. The narrowband shape is determined and compared to templates in respective vector quantizer codebooks, to select respective highband shape and gain. The synthesized wideband excitation signal is then filtered to provide a highband signal which is, in turn, added to the narrowband signal, interpolated to the 16 kHz sample rate, to produce an artificial wideband signal. The apparatus may be implemented on a digital signal processor chip.

15 Claims, 5 Drawing Sheets

SPEECH BANDWIDTH EXTENSION METHOD AND APPARATUS

The present invention relates to speech processing of narrowband speech in telephony and is particularly concerned with bandwidth extension of a narrow band speech signal to provide an artificial wideband speech signal.

BACKGROUND OF THE INVENTION

The bandwidth for the telephone network is 300 Hz to 3200 Hz. Consequently, transmission of speech through the telephone network results in the loss of the signal spectrum in the 0–300 Hz and 3.2–8 kHz bands. The removal of the signal in these bands causes a degradation of speech quality manifested in the form of reduced intelligibility and enhanced sensation of remoteness. One solution is to transmit wideband speech, for example by using two narrowband speech channels. This, however, increases costs and requires service modification. It is, therefore, desirable to provide an enhanced bandwidth at the receiver that requires no modification to the existing narrowband network.

SUMMARY OF THE INVENTION

An object of the present invention is to provide an improved speech processing method and apparatus.

In accordance with an aspect of the present invention there is provided speech bandwidth extension apparatus comprising: an input for receiving a narrowband speech signal sampled at a first rate; LPC analysis means for determining, for a speech frame having a predetermined duration of the speech signal, LPC parameters $a_i$; inverse filter means for filtering each speech frame in dependence upon the LPC parameters for the frame to produce a narrowband excitation signal frame; excitation extension means for producing a wideband excitation signal sampled at a second rate in dependence upon pitch and power of the narrowband excitation signal; lowband shape means for determining a lowband shape vector in dependence upon the LPC parameters; voiced/unvoiced means for determining voiced and unvoiced speech frames; gain and shape vector quantizer means for selecting predetermined highband shape and gain parameters in dependence upon the lowband shape vector for voiced speech frames and selecting fixed predetermined values for unvoiced speech frames; filter bank means responsive to the selected parameters for filtering the wideband excitation signal to produce a highband speech signal; interpolation means for producing a lowband speech signal sampled at the second rate from the narrow band speech signal; and adder means for combining the highband speech signal and the lowband speech signal to produce a wideband speech signal.

In an embodiment of the present invention the gain and shape vector quantizer means includes a first plurality of vector quantizer codebooks, one for each respective one of the plurality of highband shapes and a second plurality of vector quantizer codebooks, one for each respective one of the plurality of highband gains, each vector quantizer codebook of the first plurality having a plurality of lowband spectral shape templates which statistically correspond to the respective predetermined highband shape, and each vector quantizer codebook of the second plurality having a plurality of lowband spectral shape templates which statistically correspond to the respective predetermined highband gain.

In an embodiment of the present invention the excitation extension means includes interpolation means for producing a lowband excitation signal sampled at the second rate from the narrow band speech signal, pitch analysis means for determining pitch parameters for the lowband excitation signal, inverse filter means for removing pitch line spectrum from the lowband excitation signal to provide a pitch residual signal, power estimator means for determining a power level for the pitch residual signal, noise generator means for producing a wideband white noise signal having a power level similar to the pitch residual signal, pitch synthesis filter means for adding an appropriate line spectrum to the wideband white noise signal to produce the wideband excitation signal, and energy normalization means for ensuring that the wideband excitation signal and narrowband excitation signal have similar spectral levels.

In accordance with another aspect of the present invention there is provided a method of speech bandwidth extension comprising the steps of: analyzing a narrowband speech signal, sampled at a first rate, to obtain its spectral shape and its excitation signal; extending the excitation signal to a wideband excitation signal, sampled at a second, higher rate in dependence upon an analysis of pitch of the narrowband excitation signal; correlating the narrowband spectral shape with one of a plurality of predetermined highband shapes and one of a plurality of highband gains; filtering the wideband excitation signal in dependence upon the predetermined highband shape and gain to produce a highband signal; interpolating the narrowband speech signal to produce a lowband speech signal sampled at the second rate; and adding the highband signal and the lowband signal to produce a wideband signal sampled at the second rate.

In an embodiment of the present invention the step of correlating includes the steps of: providing a first plurality of vector quantizer codebooks, one for each respective one of the plurality of highband shapes and a second plurality of vector quantizer codebooks, one for each respective one of the plurality of highband gains, each vector quantizer codebook of the first plurality having a plurality of lowband spectral shape templates which statistically correspond to the respective predetermined highband shape, and each vector quantizer codebook of the second plurality having a plurality of lowband spectral shape templates which statistically correspond to the respective predetermined highband gain; comparing the narrowband spectral shape obtained with the vector quantizer codebook templates; and selecting the respective highband shape and highband gain whose respective codebooks include the template closest to the narrowband spectral shape.

An advantage of the present invention is providing an artificial wideband speech signal which is perceived to be of better quality to than a narrowband speech signal, without having to modify the existing network to actually carry the wideband speech. Another advantage is generating the artificial wideband signal at the receiver.

DETAILED DESCRIPTION

Figure 1:
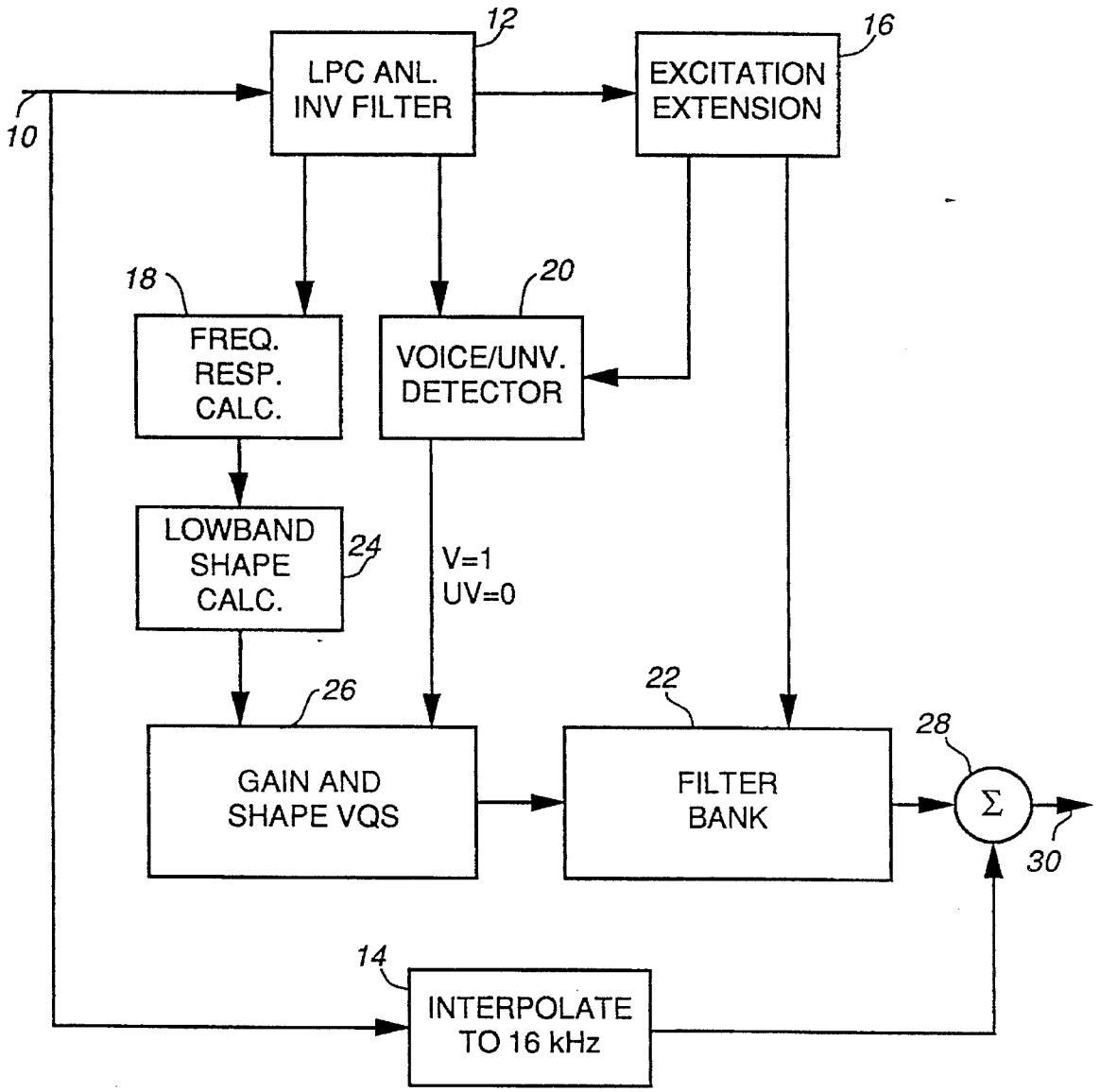
FIG. 1 illustrates, in functional block diagram form, a speech processing apparatus in accordance with an embodiment of the present invention.

Referring to FIG. 1, there is illustrated, in functional block diagram form, a speech processing apparatus in accordance with an embodiment of the present invention. The speech processing apparatus includes an input 10 for narrowband speech sampled at 8 kHz, an LPC analyzer and inverse filter block 12 and an interpolate to 16 kHz block 14, each connected to the input 10. The LPC analyzer and inverse filter block 12 has outputs connected to an excitation extension block 16, a frequency response calculation block 18 and a voiced unvoiced detector 20. The excitation extension block 16 has outputs connected to the voiced unvoiced detector 20 and a filter bank 22. The frequency response calculation block 18 has an output connected to a lowband shape calculation block 24. The lowband shape calculation block 24 and the voiced unvoiced detector 20 have outputs connected to a gain and shape VQ block 26. The output of the gain and shape VQ block 26 is input to the filter bank block 22. The output of the filter bank block 22 and the interpolate to 16 kHz block 14 are connected to an adder 28. The adder 28 has an output 30 for artificial wideband speech.

In operation, the speech processing apparatus uses a known model of the speech production mechanism consisting of a resonance box excited by an excitation source. The resonator models the frequency response of the vocal tract and represents the spectral envelope of the speech signal. The excitation signal corresponds to glottal pulses for voiced sounds and to wide-spectrum noise in the case of unvoiced sounds. The model is computed in the LPC analyzer and inverse filter block 12, by performing a known LPC analysis to yield an all-pole filter that represents the vocal tract and by applying an inverse LPC filter to the input speech to yield a residual signal that represents the excitation signal. The apparatus first decouples the excitation and vocal tract response (or spectral shape) components from the narrowband speech using an LPC inverse filter of block 12, and then independently extends the bandwidth of each component. The bandwidth extended components are used to form an artificial highband signal. The original narrowband speech signal is interpolated to raise the sampling rate to 16 kHz, and then summed with the artificially generated highband signal to yield the artificial wideband speech signal.

Extension of spectral envelope is performed to obtain an estimate of the highband spectral shape based on the spectrum of the narrowband signal. LPC analysis by the LPC analyzer and inverse filter block 12 is used by the frequency response calculation block 18 and lowband shape calculator block 24 to obtain the spectral shape of the narrowband signal. The estimated highband spectral shape generated by the gain and shape VQ block 26 is then impressed onto the extended excitation signal from the excitation extension block 16 using the filter bank 22.

LPC analysis is performed by the LPC analyzer and inverse filter block 12 to obtain an estimate of the spectral envelope of the 8 kHz sampled narrowband signal. The narrowband excitation is then extracted by filtering the input signal with the corresponding LPC inverse filter. This signal forms the input to the excitation extension block 16.

The spectral envelope or vocal tract frequency response is modelled by a ten-pole filter denoted in Z-transform notation by equation 1:

$$A(z) = \frac{1}{1 - F(z)} \tag{1}$$

where F(z) is given by equation 2:

$$F(z) = \sum_{i=1}^{10} a_i z^{-i} \tag{2}$$

The parameters of the model $a_i$, i=1 , . . . , 10 are obtained from the narrowband speech signal using the autocorrelation method of LPC analysis. An analysis window length of 20 ms is used, and a Hamming window is applied to the input speech prior to analysis.

Passing the input speech through the LPC inverse filter of block 12 given by (1–F(z)) yields the excitation signal. The 10 ms frame at the center of the analysis window is filtered by the LPC inverse filter, and the excitation sequence thus obtained forms the input to the excitation extension block 16. The analysis window is shifted by 10 ms for the next pass.

The purpose of the frequency response calculation block 18 is to obtain the shape of the lowband spectrum which is used by the gain and shape VQ block 26 to determine the highband spectral shape parameters. The log spectral level S(f) at frequency f is given by equation 3:

$$S(f) = \log\left(\left|\frac{1}{1 - \sum_{i=1}^{10} a_i e^{-j\frac{2\pi f i}{f_s}}}\right|\right) \tag{3}$$

where $f_s$ is the sampling frequency (8 kHz), and the parameters $a_i$ are obtained from LPC analysis. The frequency range from 300 Hz to 3000 Hz is partitioned into ten uniformly spaced bands. Within each band the log spectrum is computed at three uniformly spaced frequencies. The values within each band are then averaged. The frequency response calculation block 18 then passes the log spectrum values to the lowband shape calculation block 24. The lowband shape calculation block 24 averages the log spectrum values within each band. This yields a ten-dimensional vector representing the lowband log spectral shape. This vector is used by the gain and shape VQ block 26 to determine the highband spectral shape.

A vector quantizer, shape VQ, within the gain and shape VQ block 26 is used in voiced speech frames to assign one of two predetermined spectral envelopes to the 4–7 kHz frequency range. The VQ codebooks contain lowband shape templates which statistically correspond to one of the two highband shapes. The observed lowband log spectral shape is compared with these templates, to decide between the two possible shapes.

There are two separate VQ codebooks related to the two possible normalized highband shapes. They are denoted by VQS1 and VQS2 corresponding to normalized shape vectors $g_{s1}$ and $g_{s2}$ respectively. Each codebook contains 64 lowband log spectral shape templates. The templates in VQS1 for example, are a representation of lowband log spectra which correspond to highband shape $g_{s1}$, as observed with a large training set. Similarly, VQS2 contains templates corresponding to $g_{s2}$. The decision between $g_{s1}$ and $g_{s2}$ is made by first computing the log spectral shape of the observed narrowband frame in blocks 18 and 24, then comparing the lowband shape vector obtained by calculating the minimum Euclidean distances ds1 and ds2 to the codebooks VQS1 and VQS2, respectively. The estimated highband shape vector $g_s$ is then given by equation 4:

$$\vec{g}_s = \begin{cases} \vec{g}_{s1} & \frac{ds1}{ds2} < 0.7 \\ \vec{g}_{s2} & \frac{ds2}{ds1} < 0.7 \\ \left(\frac{ds2}{ds1+ds2}\right)\cdot\vec{g}_{s1} + \left(\frac{ds1}{ds1+ds2}\right)\cdot\vec{g}_{s2} & \text{otherwise} \end{cases} \quad (4)$$

For unvoiced frames the gains for the 4–5 kHz, 5–6 kHz and 6–7 kHz filters are set, respectively to 6 dB, 9 dB and 13 dB below the average lowband spectral level. Whether frames are voiced or unvoiced is determined by the voiced unvoiced detector 20.

A vector quantizer, gain VQ, within the gain and shape VQ block is used in voiced frames to assign one of two precomputed power levels to the highband gains. They are denoted by VQG1 and VQG2 corresponding to highband gains $g_{HB}(1)$ and $g_{HB}(2)$, respectively. Each codebook contains 64 lowband log spectral shape templates. The templates in VQG1 are a representation of lowband log spectral shapes which correspond to highband gain $g_{HB}(1)$, and VQG2 contains templates corresponding to highband gain $g_{HB}(2)$. The minimum distances of the observed narrowband log spectral shape to the gain VQ codebooks VQG1 and VQG2 are calculated. Let these distances be denoted by dg1 and dg2, respectively. The estimated highband gain $g_{HB}$ is then given by equation 5:

$$g_{HB} = \begin{cases} g_{HB}(1) & \frac{db1}{dg2} < 0.7 \\ g_{HB}(2) & \frac{dg2}{dg1} < 0.7 \\ \left(\frac{dg2}{dg1+dg2}\right)\cdot g_{HB}(1) + \left(\frac{dg1}{dg1+dg2}\right)\cdot g_{HB}(2) & \text{otherwise} \end{cases} \quad (5)$$

In addition, a limiter is applied to the average gain $g_{HB}$, using an estimate of the minimum spectral level ($S_{min}$) of the lowband. The estimated highband gain $g_{HB}$ is replaced by $$\mathrm{MAX}(\mathrm{Min}(g_{HB}\cdot 1S_{min}), g_{HB}(1))$$

where $g_{HB}(1)$ is the lower gain value. $S_{min}$ is estimated from the samples of the lowband spectrum.

The manner in which VQ codebooks are designed is explained in detail hereinbelow with reference to FIGS. 4 through 6

The voiced/unvoiced detector 20 makes a voiced/unvoiced state decision. The decision is made on the basis of the state of the previous frame, the normalized autocorrelation for lag 1 for the current frame, and the pitch prediction gain of the current frame. The autocorrelation for lag i of the input speech frame is denoted by R(i) and is defined in equation 9 as:

$$R(i) = \sum_{j=1}^{N} x(n)\cdot x(n-i) \quad (9)$$

where x(n) is the input narrowband speech sequence, and N is the frame length. The normalized autocorrelation for lag 1 is given by equation 10:

$$\mathrm{R1R0} = \mathrm{R(1)/R(0)} \quad (10)$$

This is calculated as a part of the LPC analysis performed by the LPC analysis and inverse filter block 12 and the value of ROR1 is passed to the voiced unvoiced detector 20.

The pitch gain is defined in equation 11 as $$\text{Pitch gain} = 20\cdot\log\left(\frac{\text{Power of input to pitch inverse filter}}{\text{Power of output of pitch inverse filter}}\right) \quad (11)$$

The pitch gain is calculated by the excitation extension block and the value is passed to the voice unvoiced detector 20.

If the previous frame is in the voiced state, then the current frame is also declared to be voiced except if the pitch gain is less than 2 dB and R1R0 is less than 0.2. If the previous frame is in the unvoiced state, then the current frame is also unvoiced unless R1R0 is greater than 0.3, or the pitch gain is greater than 2 dB.

The spectral level for the 3.2–4 kHz band is the average spectral level for the 3.0–3.2 kHz band multiplied by a scaling factor. This scalar is chosen out of four predetermined values based on an estimate of the slope of the signal spectrum at the 3.2 kHz frequency. The slope is computed in equation 12 as $$\text{slope} = \frac{S(3200) - S(3150)}{50} \quad (12)$$

If the slope is positive the largest scaling factor is used. If the slope is negative, it is quantized by a four-level quantizer and the quantizer index is used to pick one of the four predetermined values. The product of the selected scaling factor and the average spectral level of the 3–3.2 kHz band yields the level for the 3.2–4 kHz band.

Figure 2:
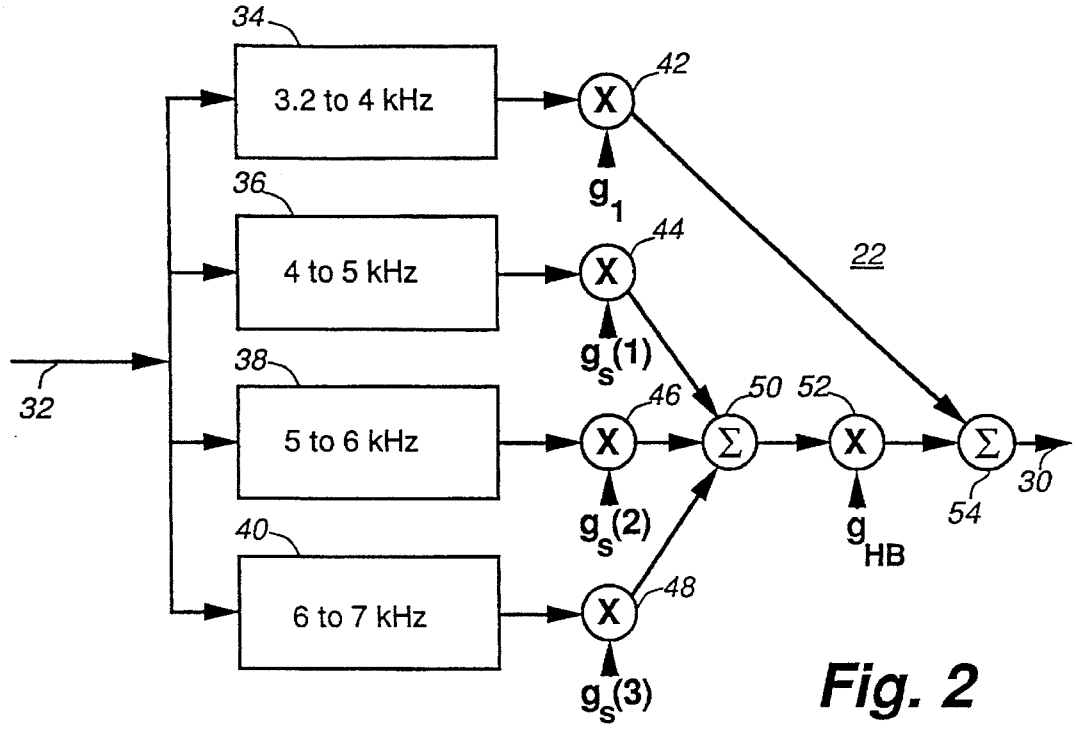
FIG. 2 illustrates, in functional block diagram form, a filter bank block of FIG. 1.

Referring to FIG. 2, there is illustrated, in functional block diagram form, the filter bank of FIG. 1. The filter bank 22 includes an input 32 for the extended excitation signal, four IIR bandpass filters 34, 36, 38, and 40 having ranges 3.2 to 4 kHz, 4 to 5 kHz, 5 to 6 kHz, and 6 to 7 kHz, respectively.

The outputs of the bandpass filters 34, 36, 38, and 40 are multiplied by scaling factors $g_1$, $g_s(1)$, $g_s(2)$, and $g_s(3)$, respectively, with multipliers 42, 44, 46, and 48, respectively. The outputs of multipliers 44, 46, and 48 are summed by an adder 50 and multiplied by a scaling factor $g_{HB}$ with multiplier 52, then summed in an adder 54 with the output of multiplier 42 to provide at the output 30 the artificial highband signal.

In operation, the narrowband excitation signal output from the excitation extension block 12 is extended to obtain an artificial wideband excitation signal at a 16 kHz sampling rate. Between 3.2 kHz and 7 kHz, the spectrum of this excitation signal has to be shaped, i.e. an estimate of the highband spectral shape has to be inserted. This is achieved by passing the excitation through the bank of four IIR bandpass filters 34, 36, 38, and 40. The gains $g_1$, vector $g_s=(g_s(1), g_s(2), g_s(3))$ and $g_{HB}$, give the highband spectrum its shape.

The gains applied to the filters controlling the 4 kHz to 7 kHz range are parametrized by a normalized shape vector $g_s=(g_s(1), g_s(2), g_s(3))$ and an average gain $g_{HB}$, yielding actual gains of $g_{HB}g_s(1)$, $g_{HB}g_s(2)$ and $g_{HB}g_s(3)$ for the 4–5 kHz, 5–6 kHz and 6–7 kHz filters, respectively. These gain parameters are determined from the lowband spectral shape information. The gain $g_1$ for the 3.2–4 kHz filter is obtained separately based on the determined shape of the 3–3.2 kHz band.

Figure 3:
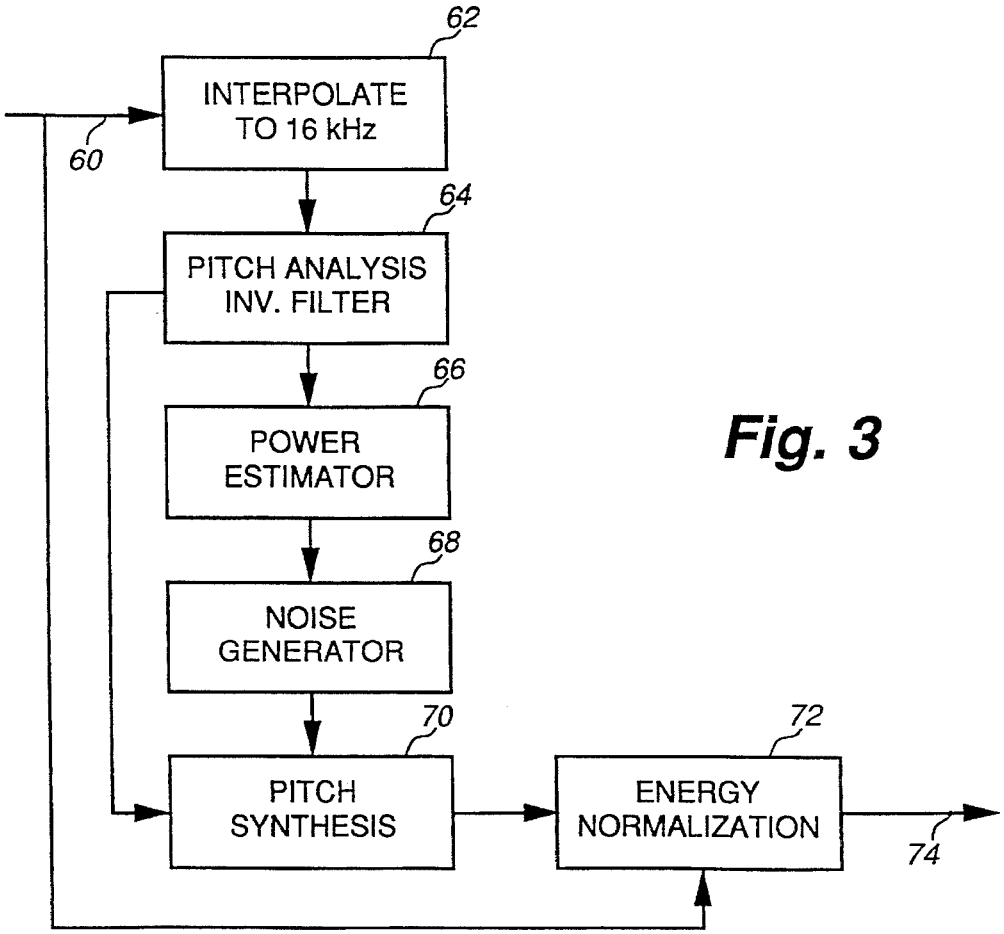
FIG. 3 illustrates, in functional block diagram form, an excitation extension block of FIG. 1.

The excitation extension block 16 generates an artificial wideband excitation at a 16 kHz sampling frequency. A functional block diagram is shown in FIG. 3. The excitation extension block 16 includes an input 60 for the narrowband excitation signal at 8 kHz, an interpolate to 16 kHz block 62, a pitch analysis inverse filter 64, a power estimator 66, a noise generator 68, a pitch synthesis filter 70, an energy normalizer 72 and an output 74 for a wideband excitation signal at a sampling rate of 16 kHz.

It is observed that for voiced sounds, the excitation signal has a line spectrum with a flat envelope such that the line spectrum is more pronounced at low frequencies and less pronounced at high frequencies. The generation of the wideband excitation is based on the generation of an artificial signal in the highband whose special characteristics match that of the lowband excitation spectrum.

The input signal sampled at 8 kHz is interpolated to a sampling rate of 16 kHz by the block 62. A pitch analysis is performed on the interpolated narrowband excitation signal, and then the interpolated narrowband excitation signal is passed through an inverse pitch filter in block 64. The inverse filter removes any line spectrum in the excitation. The power estimator block 66 then determines the power level of the pitch residual signal input from the block 64. Then the noise generator 68 passes a white noise signal, at the same power level as the pitch residual signal, through the pitch synthesis filter 70 to reintroduce the appropriate line spectrum component in the highband. A less pronounced highband line spectrum is achieved by softening the pitch coefficient.

The pitch analysis uses a one-tap pitch synthesis filter is given in Z-transform notation by $$\frac{1}{1-\beta z^{-L}}$$

where $\beta$ is the pitch coefficient and L is the lag. A 5 ms analysis window together with the covariance formulation for LPC analysis are used to obtain the optimal coefficient $\beta$ for a given lag value L. Lags in the range from 41 to 320 samples are exhaustively searched to find the best (in the sense of minimizing the mean square pitch prediction error) lag $L_{opt}$ and the corresponding coefficient $\beta_{opt}$. The 16 kHz narrowband excitation is then passed through the corresponding inverse pitch filter given by $$(1-\beta_{opt}Z^{-Lopt})$$

Any line spectrum present in the narrowband excitation will not be present in the output of the inverse pitch filter. Generation of the artificial wideband excitation is achieved by passing a noise signal, with the same spectral characteristics as the pitch residual output from the inverse filter 64, through the corresponding pitch synthesis filter 70. The pitch synthesis filter 70 adds in the appropriate line spectrum throughout the whole band.

In general, the output of the inverse pitch filter has a random spectrum with a flat envelope in the lowband. A power estimate of this signal is first obtained by the power estimator 66 and a noise generator 68 is used to generate a white Gaussian noise signal having a bandwidth of 0 to 8 kHz and the same spectral level as the narrowband excitation signal. The output of the noise generator 68 is used to drive the pitch synthesis filter 70, H(z) given by equation 13:

$$H(z)=\frac{1}{1-\beta z^{-Lopt}} \tag{13}$$

where $$\beta=0.9\beta_{opt}$$

In order to slightly reduce the degree of periodicity in the highband, $\beta$ is used instead of $\beta_{opt}$.

During certain segments it is possible for the pitch coefficient $\beta_{opt}$ to be very high. This is particularly true during the beginning of words which are preceded by silence. A very high value of $\beta_{opt}$ yields a highly unstable pitch synthesis filter. To circumvent this problem energy normalization is done by the energy normalizer 72 whenever the value of $\beta_{opt}$ exceeds 7. Energy normalization is carried out by estimating the spectral level of the narrowband excitation from the input 60 then scaling the output of the pitch synthesis filter 70 to ensure that the spectral level of the artificial wideband excitation is the same as that of the narrowband excitation.

Figure 4:
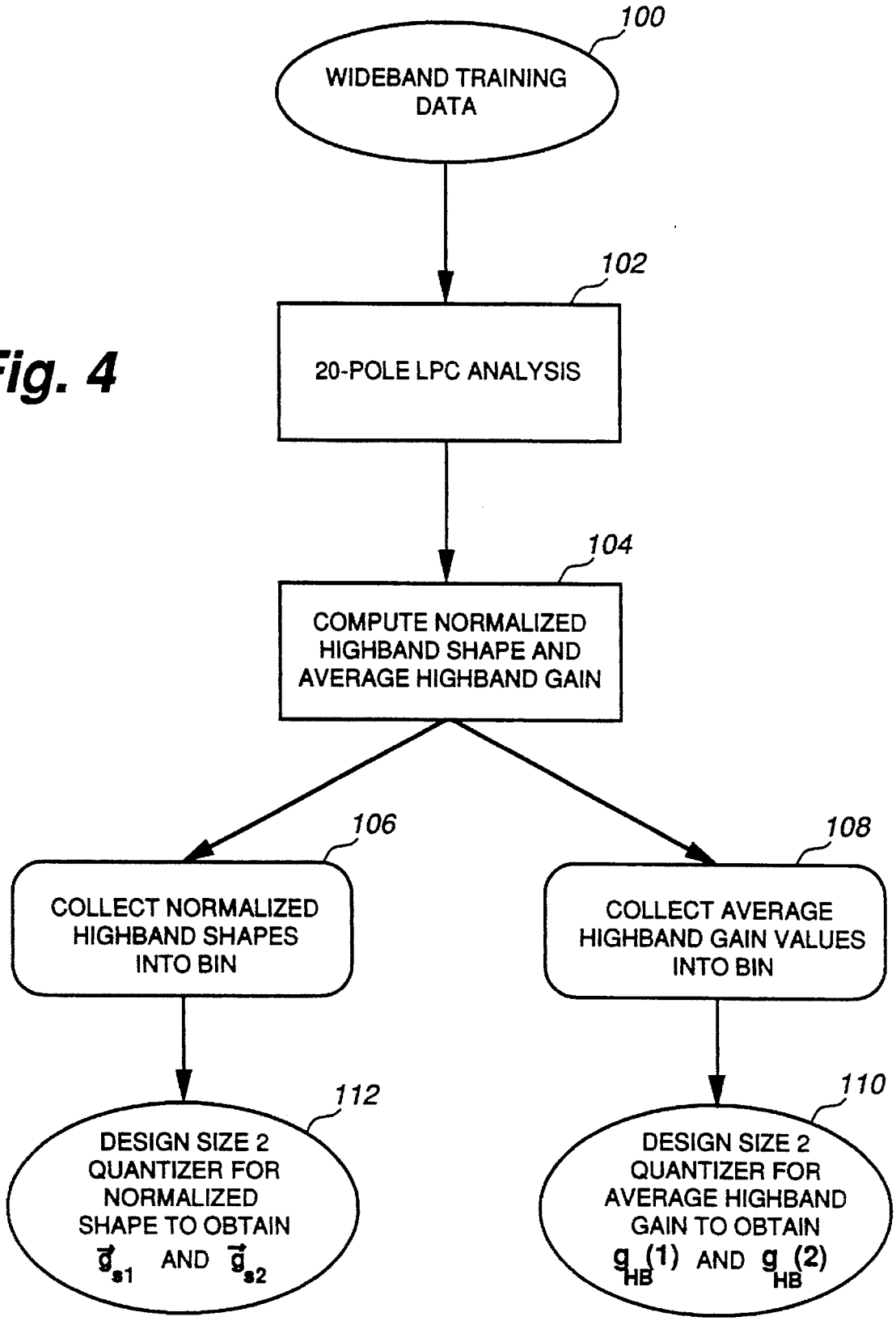
FIG. 4 illustrates, in a flow chart, a method of designing quantizers for normalized highband shape and average highband gain for use in the present invention.

Referring to FIG. 4 there is illustrated in a flow chart the procedure for designing quantizers for normalized highband shape and average highband gain.

A large training set of wideband voiced speech, as represented by a block 100, is used to train the codebooks in question. The training set consists of a large set of frames of voiced speech. The procedure is as follows:

For each frame, a 20-pole LPC analysis is used to obtain the LPC spectrum as represented by a block 102. The LPC spectrum between 300 Hz and 3000 Hz is sampled in the same manner as described hereinabove with respect to the frequency response calculation block 18, using a sampling frequency of 16 kHz. This yields a lowband shape vector for the frame. For the highband shape, the 4 kHz-5 kHz, 5 kHz-6 kHz, and the 6 kHz-7 kHz bands are sampled at 10 uniformly spaced points in each band. The sampled LPC spectrum at frequency f is given by equation 6:

$$S(f)=\left|\frac{1}{1-\sum_{i=1}^{20} a_i e^{\frac{-j2\pi fi}{f_s}}}\right| \quad (6)$$

The values within each band are averaged to yield an average value per band, that is $g_s(s)$, $g_s(2)$, and $g_s(3)$ for the 4 kHz-5 kHz, 5 kHz-6 kHz, and the 6 kHz-7 kHz bands, respectively.

Average highband gain and normalized highband shape are computed in the following way, as represented by a block 104. The average highband gain is $g_{av}=(g(1)+g(2)+g(3))/3$. The highband shape is represented by a 3-dimensional vector given by equation 7.

$$\vec{g}_s=(g_s(1),g_{s(2),g_s}(3)) \quad (7)$$

The normalized highband shape vector is given by equation 8.

$$\vec{g}_{s_N}=\frac{1}{g_{av}}(g_s(1),\ g_s(2),\ g_s(3)) \quad (8)$$

The normalized highband shapes and the average highband gain values are collected for all the wideband training data, as represented by blocks 106 and 108, respectively. Then, using the collected normalized highband shapes and collected average highband gain values, size 2 codebooks for the average gain and normalized highband shape are obtained, as represented by blocks 110 and 112 respectively. This is done using the standard splitting technique described by Robert M. Gray, "Vector Quantization", IEEE ASSP Magazine, April 1984.

Figure 5:
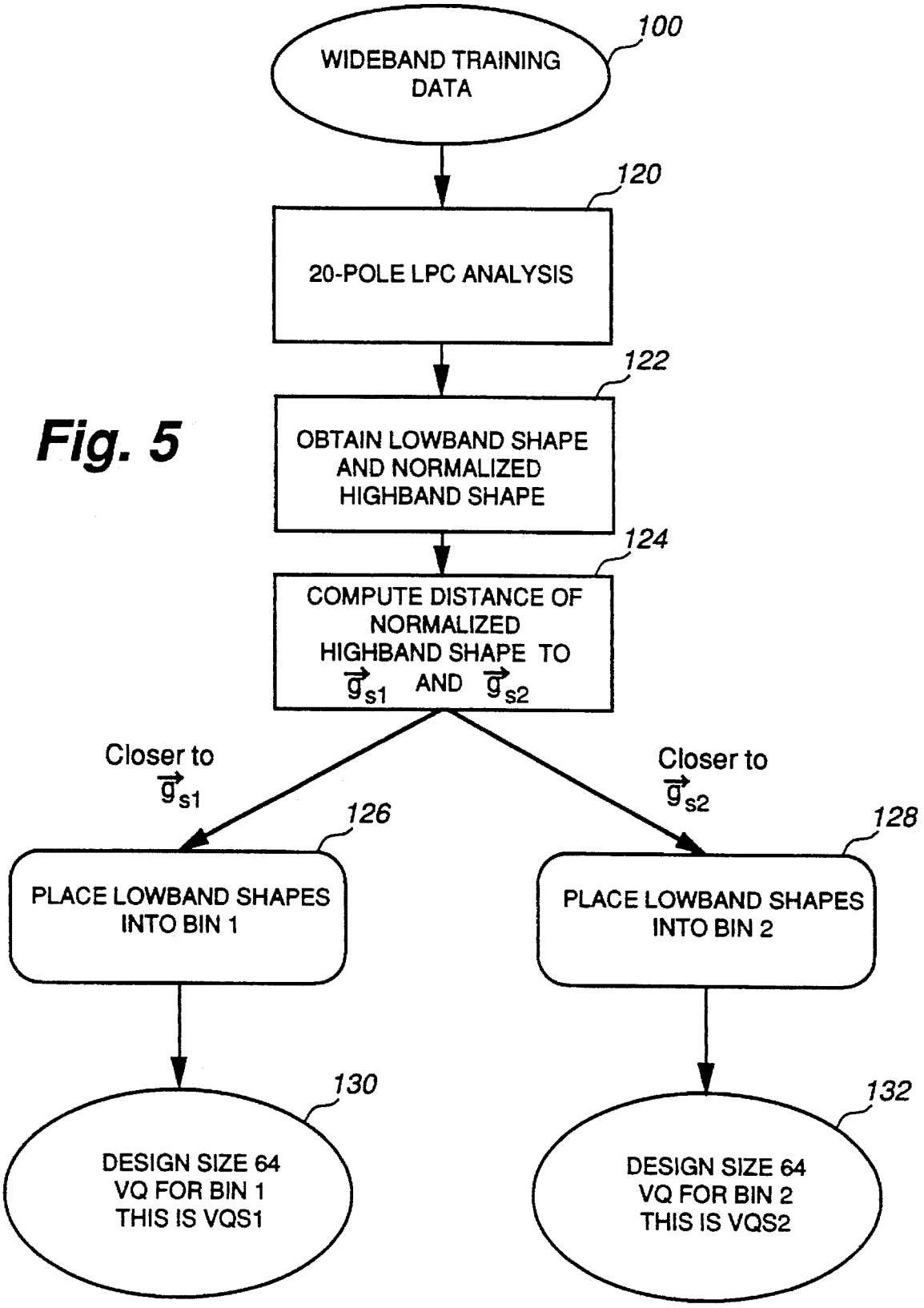
FIG. 5 illustrates, in a flow chart, a method of designing codebooks, for use in the present invention, for determining normalized highband shape based upon lowband shape.
Figure 6:
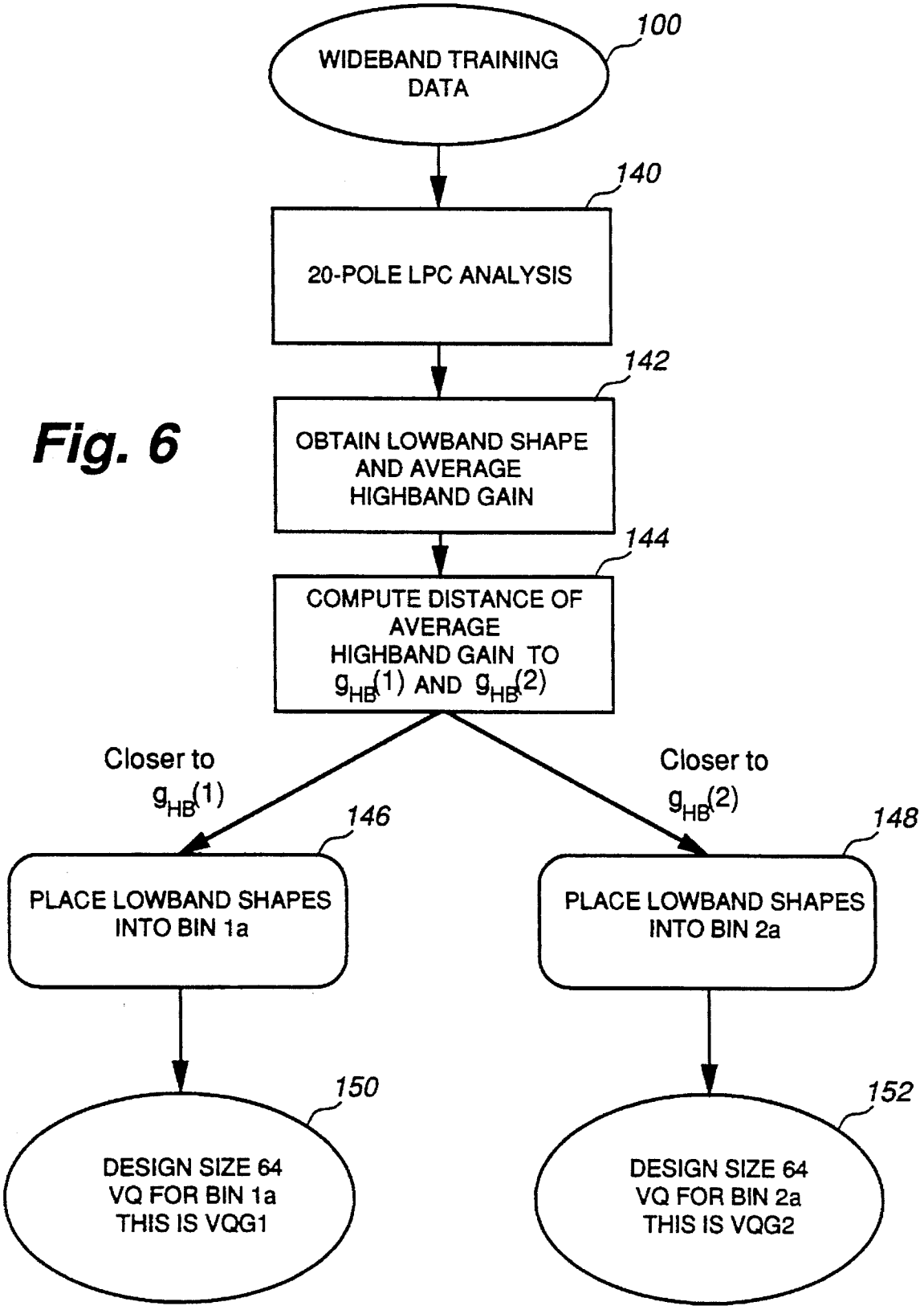
FIG. 6 illustrates, in a flow chart, a method of designing codebooks, for use in the present invention, for determining average highband gain based upon lowband shape.

The two size 2 quantizers obtained by the procedure of FIG. 4 are used in procedures shown in FIGS. 5 and 6 to determine the vector quantizer codebooks for shape VQS1 and VQS2 and gain VQG1 and VQG2.

In FIG. 5, the wideband training set, as represented by the block 100, undergoes a 20-pole LPC analysis as represented by a block 120, to obtain log lowband shape for each frame as represented by a block 122. The normalized highband shape is quantized, as represented by a block 124, using the 2 code word codebook obtained from the design procedure of FIG. 4. Two lowband shape bins are created corresponding to normalized highband shape code word 1 (vector $g_{s1}$) and normalized highband shape code word 2 (vector $g_{s2}$). In this way, lowband shape is correlated with highband shape.

For a given frame of wideband speech in the training set, if the normalized highband shape is closer to vector $g_{s1}$, then the corresponding lowband shape is placed into bin 1, as represented by a block 126. If the highband shape is closer to vector $g_{s2}$, then the corresponding lowband shape is placed into bin 2, as represented by a block 128.

The codebook VQS1 is obtained by designing a 64 size codebook of bin 1 using the standard splitting technique described by Robert Gray in "Vector Quantization", as represented by a block 130. Similarly, VQS2 is obtained by designing a size 64 codebook of bin 2 as represented by a block 132.

In FIG. 6, the wideband training set 100, undergoes a 20-pole LPC analysis 140 to obtain 142 highband gain and log lowband shape for each frame. The average highband shape is quantized 144 using the 2 code word codebook obtained from the design procedure of FIG. 4. Two lowband shape bins are created corresponding to average highband gain code word 1 $g_{HB}(1)$ and average highband gain code word 2 $g_{HB}(2)$.

For a given frame of wideband speech in the training set, if the average highband gain is closer to $g_{HB}(1)$ then the lowband shape is placed into bin 1, as represented by a block 146. If the average highband gain is closer to $g_{HB}(2)$, then the corresponding lowband shape is placed into bin 2, as represented by a block 148.

The codebook VQG1 is obtained by designing a 64 size codebook of bin 1 using the standard splitting technique described by Robert Gray in "Vector Quantization", as represented by a block 150. Similarly, VQG2 is obtained 152 by designing a size 64 codebook of bin 2, as represented by a block 152.

In a particular embodiment of the present invention, the apparatus of FIG. 1 is implemented on a digital signal processor chip, for example, a DSP56001 by Motorola. For such implementations, the issues of computation complexity of the various functional blocks, delay, and memory requirements should be considered. Estimates of the computational complexity of the functional blocks of FIG. 1 are given in Table A. The estimates are based upon an implementation using the DSP56001 chip.

TABLE A

| FUNCTIONAL BLOCKS | ESTIMATED MIPS |
|---|---|
| LPC analysis and inverse filtering | 1.03 |
| Filter bank implementation | 2.0 |
| Pitch analysis and inverse filtering | 2.43 |
| Interpolation | 0.95 |
| Shape VQ search | 0.135 |
| Gain VQ search | 0.135 |
| Frequency Response Calculation | 0.007 |
| Miscellaneous | 0.135 |
| TOTAL | 6.82 |

The total estimated computational complexity is 6.8 MIPS. This represents about 50% utilization of the DSP56001 chip operating at a clock frequency of 27 MHz.

Total delay introduced by the speech processing apparatus consists of input buffering delay and processing time. The delay due to buffering the input speech signal is about 15 ms. At the clock rate of 27 MHz and the computational complexity of 6.8 MIPS the delay due to processing is about 3 ms. Hence, the total delay introduced by the speech processing apparatus is about 18 ms.

Memory requirements for data and program memory are approximately 3K and 1K words, respectively.

An advantage of the present invention is providing an artificial wideband speech signal which is perceived to be of better quality than a narrowband speech signal, without having to modify the existing network to actually carry the wideband speech. Another advantage is generating the artificial wideband signal at the receiver.

In a variation of the embodiment described hereinabove, correlation of lowband shape and respective highband shape and gain may be improved by increasing the number of predetermined normalized and average highband gains, and hence the respective vector quantizer codebooks. For the particular implementation using a DSP56001 chip, the shape VQ and gain VQ searches contribute little to the overall computatinal complexity, hence real time implimentations could use more than two each. For example, an increase from 2 to 16 VQ for both shape and gain, would increase the computational complexity by 16×0.135 MIPS=2.16 MIPS. This represents an additional delay of about 1 ms.

Numerous modifications, variations, and adaptations may be made to the particular embodiments of the invention described above without departing from the scope of the invention, which is defined in the claims.

What is claimed is:

1. Speech bandwidth extension apparatus comprising:

an input for receiving a narrowband speech signal sampled at a first rate;

LPC analysis means for determining, for a speech frame having a predetermined duration of the speech signal, LPC parameters $a_i$;

inverse filter means for filtering each speech frame in dependence upon the LPC parameters for the frame to produce a narrowband excitation signal frame;

excitation extension means for producing a wideband excitation signal sampled at a second rate in dependence upon pitch and power of the narrowband excitation signal;

lowband shape means for determining a lowband shape vector in dependence upon the LPC parameters;

voiced/unvoiced means for determining voiced and unvoiced speech frames;

gain and shape vector quantizer means for selecting predetermined highband shape and gain parameters in dependence upon the lowband shape vector for voiced speech frames and selecting fixed predetermined values for unvoiced speech frames;

filter bank means responsive to the selected highband shape and gain parameters for filtering the wideband excitation signal to produce a highband speech signal;

interpolation means for producing a lowband speech signal sampled at the second rate from the narrow band speech signal; and adder means for combining the highband speech signal and the lowband speech signal to produce a wideband speech signal.

2. Apparatus as claimed in claim 1 wherein the gain and shape vector quantizer means includes a first plurality of vector quantizer codebooks, one for each respective one of a plurality of highband shapes and a second plurality of vector quantizer codebooks, one for each respective one of a plurality of highband gains, each vector quantizer codebook of the first plurality having a plurality of lowband spectral shape templates which statistically correspond to the respective predetermined highband shape, and each vector quantizer codebook of the second plurality having a plurality of lowband spectral shape templates which statistically correspond to the respective predetermined highband gain.

3. Apparatus as claimed in claim 2 wherein the first and second plurality of codebooks includes two vector quantizer codebooks corresponding to a plurality of two predetermined highband shapes and two vector quantizer codebooks corresponding to a plurality of two predetermined highband gains.

4. Apparatus as claimed in claim 3 wherein each vector quantizer codebook includes 64 lowband spectral shape templates.

5. Apparatus as claimed in claim 1 wherein the excitation extension means includes interpolation means for producing a lowband excitation signal sampled at the second rate from the narrow band speech signal, pitch analysis means for determining pitch parameters for the lowband excitation signal, inverse filter means for removing pitch line spectrum from the lowband excitation signal and producing a pitch residual signal, power estimator means for determining a power level for the pitch residual signal, noise generator means for producing a wideband white noise signal having a power level similar to the pitch residual signal, pitch synthesis filter means for adding an appropriate line spectrum to the wideband white noise signal to produce the wideband excitation signal, and energy normalization means for ensuring that the wideband excitation signal and narrowband excitation signal have similar spectral levels.

6. Apparatus as claimed in claim 1 wherein the pitch parameters are optimum values of pitch coefficient —β— and lag L from a one-tap pitch synthesis filter given in Z-transform notation by $$\frac{1}{1-\beta z^{-L}}$$

7. Apparatus as claimed in claim 1 wherein the filter bank means includes an input for the wideband excitation signal, four IIR bandpass filters having ranges 3.2 to 4 kHz, 4 to 5 kHz, 5 to 6 kHz, and 6 to 7 kHz, respectively, multipliers connected to the outputs of the bandpass filters for multiplying by a respective average value per band.

8. Apparatus as claimed in claim 7 wherein the filter bank means further includes a first adder for summing the scaled outputs of the 4 to 5 kHz, 5 to 6 kHz, and 6 to 7 kHz bandpass filters, a multiplier for multiplying the sum by a an average highband gain value, a second adder for summing the scaled sum and the scaled output of the 3.2 to 4 kHz bandpass filter to produce the highband signal.

9. Apparatus as claimed in claim 1 wherein the lowband shape means includes a frequency response calculation means for computing the log lowband spectrum values from the LPC parameters $a_i$ and a lowband shape calculation means for averaging the log lowband spectrum values in each of a plurality of n uniform frequency bands to produce and n-dimension log lowband spectral shape vector, where n is an integer.

10. A method of speech bandwidth extension comprising the steps of:

analyzing a narrowband speech signal, sampled at a first rate, to obtain a spectral shape of the narrowband speech signal and an excitation signal of the narrowband speech signal;

extending the excitation signal to a wideband excitation signal, sampled at a second, higher rate in dependence upon an analysis of pitch of the narrowband excitation signal;

correlating the narrowband spectral shape with one of a plurality of predetermined highband shapes and one of a plurality of highband gains;

filtering the wideband excitation signal in dependence upon the predetermined highband shape and gain to produce a highband signal;

interpolating the narrowband speech signal to produce a lowband speech signal sampled at the second rate; and adding the highband signal and the lowband signal to produce a wideband signal sampled at the second rate.

11. A method as claimed in claim 10 wherein the step of correlating includes the steps of:

using a first plurality of vector quantizer codebooks, one for each respective one of a plurality of highband shapes and a second plurality of vector quantizer codebooks, one for each respective one of a plurality of highband gains, each vector quantizer codebook of the first plurality having a plurality of lowband spectral shape templates which statistically correspond to the respective predetermined highband shape, and each vector quantizer codebook of the second plurality having a plurality of lowband spectral shape templates which statistically correspond to the respective predetermined highband gain;

comparing the narrowband spectral shape obtained with the vector quantizer codebook templates; and selecting the respective highband shape and highband gain whose respective codebooks include the template closest to the narrowband spectral shape.

12. A method as claimed in claim 11 wherein the step of comparing includes the steps of:

calculating distances between the narrowband spectral shape and each vector quantizer codebook template and comparing the lowest distance to a predetermined threshold; and wherein the step of selecting is dependent upon the lowest distance being less than the predetermined threshold.

13. A method as claimed in claim 12 wherein the step of using first and second pluralities of vector quantizer codebooks provides two vector quantizer codebooks corresponding to two predetermined highband shapes and a plurality of two vector quantizer codebooks corresponding to two predetermined highband gains.

14. A method as claimed in claim 13 wherein the lowest distance for each respective codebook is greater than a predetermined threshold and wherein the step of selecting includes the step of using a weighted average of the respective highband shape and gain in dependence upon the lowest distance for each respective codebook.

15. A method as claimed in claim 14 wherein each vector quantizer codebook includes 64 lowband spectral shape templates.

* * * * *